US009889330B2

(12) United States Patent
Mann

(10) Patent No.: US 9,889,330 B2
(45) Date of Patent: Feb. 13, 2018

(54) ERGONOMIC DEADLIFT EXERCISE BAR

(71) Applicant: Erik C. Mann, Long Beach, CA (US)

(72) Inventor: Erik C. Mann, Long Beach, CA (US)

( * ) Notice: Subject to any disclaimer, the term of this patent is extended or adjusted under 35 U.S.C. 154(b) by 0 days.

(21) Appl. No.: 15/298,035

(22) Filed: Oct. 19, 2016

(65) Prior Publication Data

US 2017/0106226 A1 Apr. 20, 2017

Related U.S. Application Data

(60) Provisional application No. 62/243,431, filed on Oct. 19, 2015.

(51) Int. Cl.
*A63B 21/00* (2006.01)
*A63B 21/072* (2006.01)
*A63B 23/04* (2006.01)

(52) U.S. Cl.
CPC ..... *A63B 21/0724* (2013.01); *A63B 21/4035* (2015.10); *A63B 23/0405* (2013.01); *A63B 2023/0411* (2013.01)

(58) Field of Classification Search
CPC ..... A63B 21/02–21/075; A63B 2023/0411
See application file for complete search history.

(56) References Cited

U.S. PATENT DOCUMENTS 4,018,442 A * 4/1977 Galler ..... A63B 21/0724 482/106
5,725,461 A * 3/1998 Bogard, II ..... A63B 21/072 482/106
2006/0040802 A1* 2/2006 Vittone ..... A63B 21/0724 482/106

* cited by examiner

*Primary Examiner* — Loan H Thanh
*Assistant Examiner* — Jennifer M Deichl
(74) *Attorney, Agent, or Firm* — Fulwider Patton LLP

(57) ABSTRACT

A deadlift bar includes a rectangular frame formed by front, rear, left, and right members. The frame includes a plurality of legs spaced about the frame to establish a gap between the frame and the ground, making it easier to grip the deadlift bar once the weights are loaded onto the device. Mounted to the left and right members and extending outwardly from the frame are first and second platforms, each of which may be formed by a pair of angled protruding arms joined at their respective ends by a connecting member. The platforms also include a pair of legs at the juncture of the arms with the connecting member to support the device and prevent bowing when weights are mounted thereon. Each platform further includes a support column extending upwardly from the connecting member, vertically at its base and then at an incline extending upwardly and away from the frame.

6 Claims, 1 Drawing Sheet

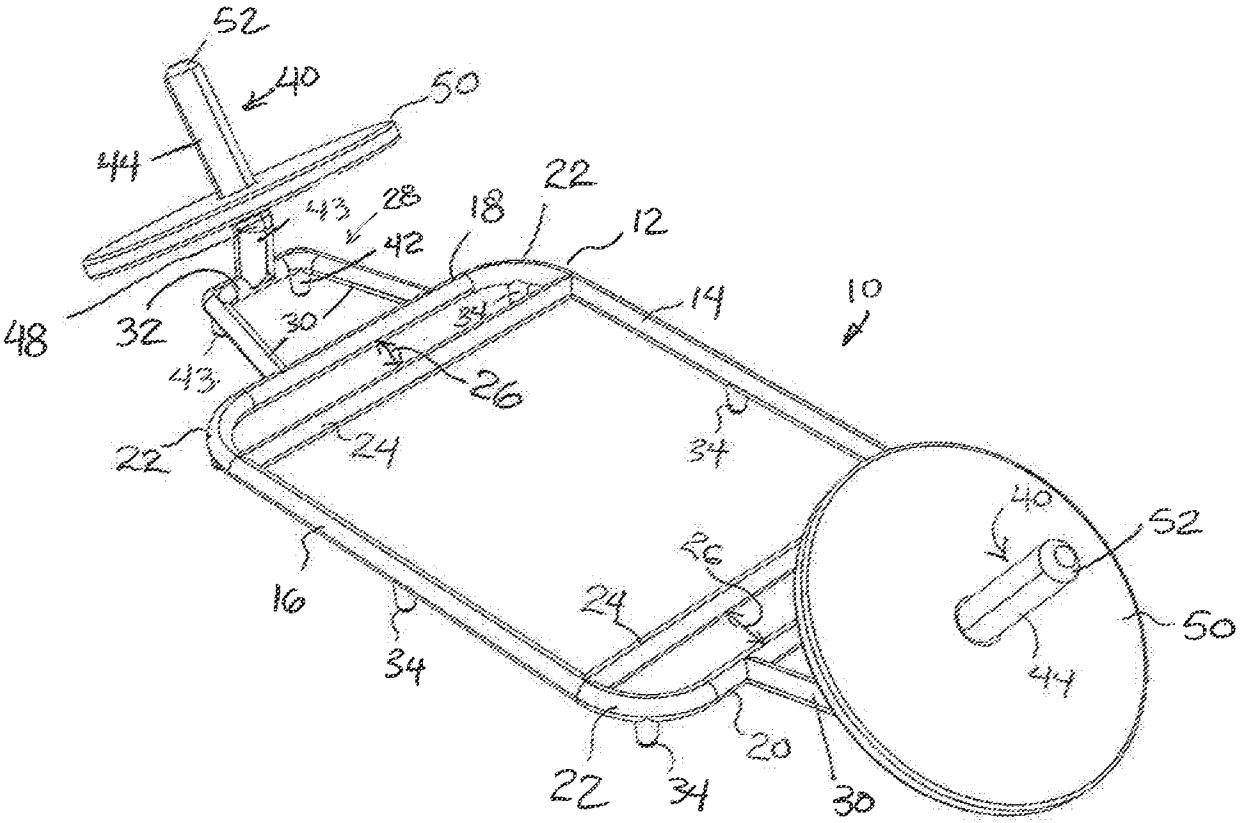
10
12
14
16
18
20
22
24
26
28
30
32
34
38
40
42
43
44
47
48
50
52

ERGONOMIC DEADLIFT EXERCISE BAR

CROSS-REFERENCES TO RELATED APPLICATIONS

This application claims priority from U.S. Application No. 62/243,431, filed Oct. 19, 2015 incorporated by reference in its entirety.

BACKGROUND

In the field of physical fitness, resistance weight training is enjoying a growth in the number of participants and the along with the businesses that cater to this rapidly evolving training regiment. Resistance training (also called strength training or weight training) employs resistance to muscular contraction to build the strength, anaerobic endurance and size of skeletal muscles. Resistance training is based on the principle that muscles of the body will work to overcome a resistance force when they are required to do so.

A growing body of research shows that working out with weights has health benefits beyond simply bulking up one's muscles and strengthening bones. Studies show that more lean muscle mass may allow kidney dialysis patients to live longer, give older people better cognitive function, can reduce depression in some patients, boost good cholesterol, lessen the swelling and discomfort of lymphedema after breast cancer, and help lower the risk of diabetes.

One downside to the enjoyment of resistance training is the injuries that often accompany novices and athletes who fail to take heed of the need for proper alignment and technique. One common ailment for weightlifters is low-back pain. In most cases this arises because of compression loading on the spinal column. Heavy loads squeeze the intervertebral discs, leading to a deformation of the vertebrae and sometimes strained ligaments. Deadlifting, an exercise that involves lifting a large weight using the large leg muscles, can lead to back injuries and muscle trauma if done improperly. This is usually caused by the lifter bending over improperly, lifting with the back muscles instead of the leg muscles, placing undue strain on the lower back.

The chief mechanical cause of back injury while doing deadlifts is similar to that causing back injuries in weighted squats, namely flexing (bending forward) of the lifter's lumbar spine. That flexing happens when the lifter either leans forward beyond the point up to which the pelvis can rotate forward (any further leaning beyond this point can be done only by flexing the spine), or when the lifter begins the lift by posterior rotation of the pelvis (tilting the pelvis backward). In either case, instead of moving the whole trunk as one solid object rotating at the hip joints, the lumbar flexion is combined with posterior tilting of the lifter's pelvis, the same as in defective squats.

The present invention is designed to allow a user to perform various resistance training exercises, including deadlifts, safely and with less risk of injury.

SUMMARY OF THE INVENTION

The present invention is a deadlift bar that includes a rectangular frame formed by front, rear, left, and right members welded or otherwise rigidly connected. A pair of rods inside the frame connecting the front and rear members serve as handles, preferably parallel to the right and left members, respectively. The handles may be covered by a foam, a plastic sheath, or a knurled surface for tactile reasons to enable a reliable grip. The frame also includes a plurality of legs spaced about the frame to establish a gap between the frame and the ground, making it easier to grip the deadlift bar once the weights are loaded onto the device. Mounted to the left and right members and extending outwardly from the frame are first and second platforms, each of which may be formed by a pair of angled protruding arms joined at their respective ends by a connecting member. The platforms may preferably also include a pair of legs at the juncture of the arms with the connecting member to support the device and prevent bowing when weights are mounted thereon. Each platform further includes a support column extending upwardly from the connecting member, vertically at its base and then at an incline extending upwardly and away from the frame. A stop is located on the support column to hold the weights and prevent them from sliding down the base of the support column, and the angled orientation of the support column helps to prevent the weights from sliding off the bar should the bar become tilted or uneven during use.

BRIEF DESCRIPTION OF THE DRAWING

FIG. 1 is an elevated, perspective view of a first preferred embodiment of the present invention.

DETAILED DESCRIPTION OF THE PREFERRED EMBODIMENTS

FIG. 1 illustrates a first preferred embodiment of the present invention. The invention is an exercise bar used in the practice of weightlifting, and more particularly deadlifting. A unique aspect of the present invention is that the user stands inside the frame of the bar and lifts the bar while the weight is centered about the user rather than lunging forward while lifting, preventing improper leaning during the lift that can lead to injuries.

The bar 10 includes a rectangular frame 12 formed by a front member 14, a rear member 16, a left member 18, and a right member 20. Rounded elbows 22 can be used to connect the adjacent members and form a closed rectangular arrangement. The members can be made of steel, or other suitable material of sufficient strength and durability to withstand the stresses of the loads placed on the bar 10. Similarly, the connections can be welded, threaded, or other suitable couplings that can reliably adjoin each element of the structure. The frame is preferably equipped with at least four and preferably six legs 34 that elevate the bar 10 off the ground so that a user can more easily grasp the device prior to lifting.

A pair of handles 24 connect the front and rear members spaced at or just off the elbows 22 to create a gap 26. The handles 24 can include a surface covering made of foam, plastic, or other material that promotes comfort and reduces hand fatigue. Alternatively, the handle may include a knurled surface to improve the gripping surface for a more reliable grasp of the bar. Standing inside the frame 12, a user can grasp the handles 24 one in each hand and lift the frame vertically without bending over as in prior weighted bars. This promotes a safer exercise that is less likely to lead to injuries and back problems. In an alternate embodiment, the handles can connect to the left and right members in a "D" shaped configuration.

Mounting to the left and right members is a platform 28 that is used to mount disk-shaped weights 50. The platform 28 is formed by first and second arms 30 extending away from the frame 12 and angled in a converging orientation and connected distally by a connecting crossbar 32. The arms 30 and the connecting crossbar 32 cooperate with the respective attached member 18,20 to form a trapezoidal extension of the frame 12. The trapezoidal extension may itself include a pair of legs 43 that are of a common height with the frame legs 34 to equally distribute the weight of the bar across the various joints and supports.

The platforms 28 include a column 40 that receives the disk-shaped weights 50. The column 40 includes a vertical post 42, which may be of a larger diameter, and an angled mounting portion 44 onto which the weights are loaded. The column 40 may include a stop 48 (a widening of the column or a rubber or other protrusion) or other mechanism for preventing the weights from shifting or lowering onto the vertical post 42. The angled mounting portion 44 may include a beveled distal end 52 to facilitate loading the weights, and may have a hexagonal or other geometric profile to prevent the disks from rotating on the column. The angled mounting portion 44 helps to prevent the weights from falling off of the bar should the bar be raised unevenly during the exercise.

The bar of the present invention promotes safety and good technique in two ways. The safety feature of the angled weight support prevents the weights from falling off the bar, a leading cause of injuries for this exercise. Further, the ability of the user to stand inside the frame and perform the lift without leaning forward to grasp the bar helps to eliminate back injuries due to improper form. The bar is sturdy and aesthetically pleasing, and is unlike any exercise bar currently in use.

The foregoing descriptions and depictions are intended to be illustrative but not limiting, and the invention is not intended to be confined to any particular preferred embodiment or illustration. Rather, one of ordinary skill in the art will readily recognize that there are various modifications and substitutions, and the scope of the present invention is intended to include all such modifications and substitutions. Accordingly, the scope of the invention is properly governed by the appended claims using their common and ordinary meanings in light of the foregoing.

I Claim:

1. An ergonomic squat bar, comprising:

a rectangular frame having a front member, a back member, a left side member, and a right side member;

a plurality of legs supporting the rectangular frame;

first and second handles rigidly attached to said rectangular frame;

first and second platforms extending from the left side member and right side member, respectively, the first and second platforms each comprising:

first and second arms extending away from the rectangular frame and a crossbar connecting the first and second arms to cooperate with the respective side member to form a trapezoidal extension;

a column centrally disposed on the crossbar, the column including a vertical post and an outwardly angled extension; and a leg supporting the platform.

2. The ergonomic squat bar of claim 1, wherein the vertical post has a larger diameter than the vertical extension.

3. The ergonomic squat bar of claim 1, wherein the column includes a stop between the vertical post and the outwardly angled extension.

4. The ergonomic squat bar of claim 1, wherein the first and second handles each extend across the rectangular frame and connect the front member to the back member.

5. The ergonomic squat bar of claim 1, wherein the vertical post has a hexagonal profile.

6. The ergonomic squat bar of claim 1, wherein a tip of the outwardly angled extension is beveled.

* * * * *